US006050703A

United States Patent [19]

Herbert

[11] Patent Number: 6,050,703

[45] Date of Patent: Apr. 18, 2000

[54] SLIDING CHRISTMAS TREE LIGHT MOUNTING ASSEMBLY

[76] Inventor: Raymond C. Herbert, Box 7871, Bonnyville, Alberta, Canada, T9N-2J2

[21] Appl. No.: 09/002,336

[22] Filed: Jan. 2, 1998

[51] Int. Cl.[7] ..... F21V 21/34

[52] U.S. Cl. ..... 362/250; 362/238; 362/145; 362/396

[58] Field of Search ..... 362/145, 152, 362/238, 239, 249, 250, 296

[56] References Cited

U.S. PATENT DOCUMENTS

| | | | |
|---|---|---|---|
| D. 350,612 | 9/1994 | Gullblom | D25/121 |
| 4,182,532 | 1/1980 | Walker, Sr. | 296/210 |
| 4,901,212 | 2/1990 | Prickett | 362/145 |
| 4,905,131 | 2/1990 | Gary | 362/249 |
| 5,067,061 | 11/1991 | Prickett | 362/145 |
| 5,388,802 | 2/1995 | Dougan et al. | 248/74.2 |
| 5,594,628 | 1/1997 | Reuter et al. | 362/249 |
| 5,707,136 | 1/1998 | Byers | 362/249 X |

*Primary Examiner*—Stephen Husar

[57] ABSTRACT

A sliding Christmas tree light mounting assembly is provided including a house having a fascia. A string of lights include an elongated flexible insulated wire with multiple light bulbs spaced along a length thereof and electrically connected to the same for receiving power therefrom. At least one elongated linear slider track is included. A plurality of slider clips are slidably coupled to the slider track and adapted to releasably secure to the string of lights for mounting the same to the fascia.

9 Claims, 3 Drawing Sheets

FIG 5
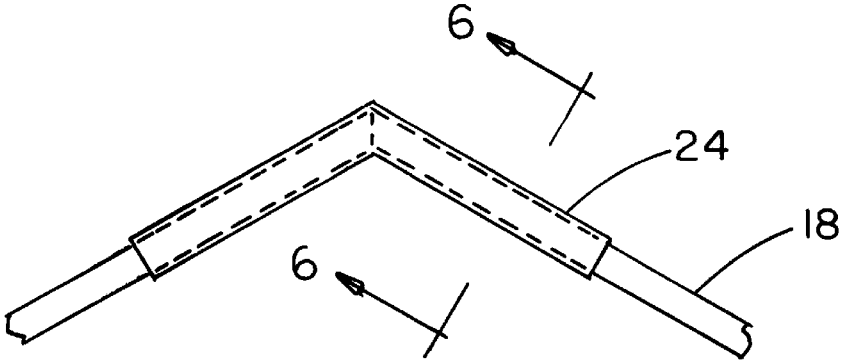
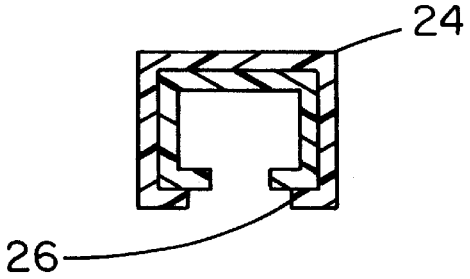
FIG 6
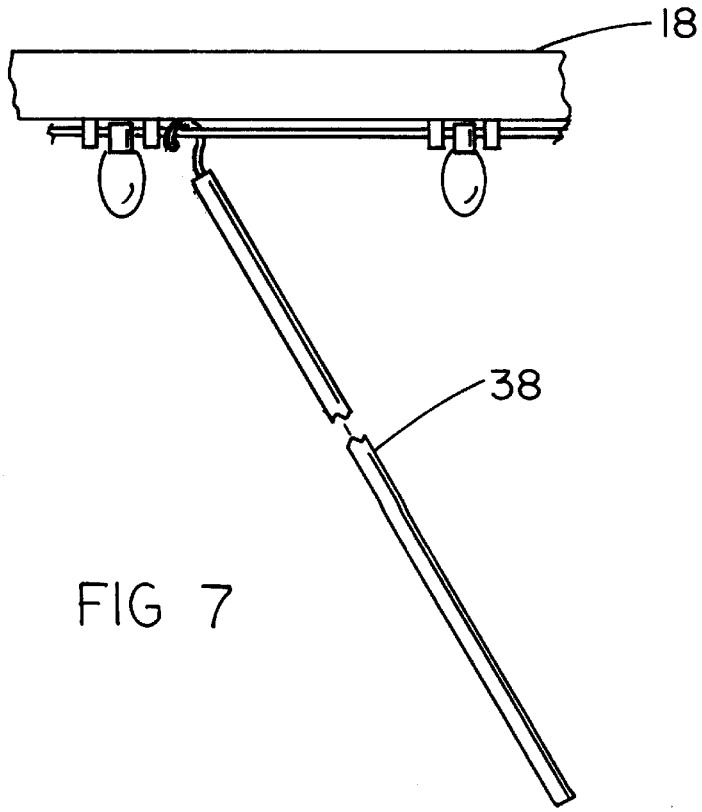
FIG 7

SLIDING CHRISTMAS TREE LIGHT MOUNTING ASSEMBLY

BACKGROUND OF THE INVENTION

1. Field of the Invention

The present invention relates to a sliding Christmas tree light mounting assembly and more particularly pertains to conveniently mounting a string of lights on a house.

2. Description of the Prior Art

The use of stationary Christmas light mounting assemblies is known in the prior art. More specifically, stationary Christmas light mounting assemblies heretofore devised and utilized for the purpose of decoration are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,388,802; U.S. Pat. No. 5,067,061; U.S. Pat. No. 4,905,131; U.S. Pat. No. 4,901,212; U.S. Pat. Des. 350,612; and U.S. Pat. No. 4,182,532.

In this respect, the sliding Christmas tree light mounting assembly according to the present invention substantially departs from the conventional concepts and designs of the prior art, and in so doing provides an apparatus primarily developed for the purpose of conveniently mounting a string of lights on a house.

Therefore, it can be appreciated that there exists a continuing need for a new and improved sliding Christmas tree light mounting assembly which can be used for conveniently mounting a string of lights on a house. In this regard, the present invention substantially fulfills this need.

SUMMARY OF THE INVENTION

In view of the foregoing disadvantages inherent in the known types of stationary Christmas light mounting assemblies now present in the prior art, the present invention provides an improved sliding Christmas tree light mounting assembly. As such, the general purpose of the present invention, which will be described subsequently in greater detail, is to provide a new and improved sliding Christmas tree light mounting assembly which has all the advantages of the prior art and none of the disadvantages.

To attain this, the present invention essentially comprises a house having a fascia. The fascia includes a horizontal extent and a pair of bevelled extents which form an apex. Also included is a string of lights having an elongated flexible insulated wire with multiple light bulbs spaced along a length thereof. Such bulbs are electrically connected to the wire for receiving power therefrom. As shown in the Figures, a plurality of elongated linear slider tracks are provided. Each of the slider tracks include an elongated rectangular top face, bottom face, front face, rear face and a pair of square open ends. The bottom face of each track has a slot formed therein along a length thereof. The top face of each track has a plurality of circular apertures formed therein along a length thereof. The apertures function for allowing the mounting of each track to a lower face of an associated one of the extents of the fascia. Next provided is an inverted V-shaped couple having a pair of hollow side extents each with a square cross-section. As shown in FIG. 5, the couple is adapted for releasably receiving an end of a pair of the slider tracks and maintaining the same at a predetermined angle. During use, the couple is situated at the apex of the bevelled extents of the fascia. FIGS. 3 & 4 best show a plurality of slider clips each having a trapezoidal-shaped cross-section in a vertical plane situated along a central extent. Each slider clip further has a rectangular planar bottom face, a rectangular planar top face, and a pair of pyramid-shaped end extents. The bottom face has a pair of spaced vertically oriented clip members. Each clip member has a top end integrally and spacedly coupled to the bottom face of the slider clip and extending downwardly therefrom. In use, the slider clips are slidably mounted within a corresponding track with the clip members extending downwardly through the slot. As shown in FIG. 3, each clip member includes a pair of abutting resilient posts. A pair of semicircular cut outs are formed in the posts of the clip member. Together, the cut outs define a circular bore which remains in coaxial relationship with that of the other clip of the slider clip. A pair of tapering bottom ends of the posts form an apex directly below the circular bore of the clip member. By this structure, the wire of the string of lights may be removably situated between the posts of each clip member and maintained within the circular bore thereof. As shown in FIG. 4, each light bulb of the string of lights is situated between the posts of the clip members of an associated slider clip.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sliding Christmas tree light mounting assembly which has all the advantages of the prior art stationary Christmas light mounting assemblies and none of the disadvantages.

It is another object of the present invention to provide a new and improved sliding Christmas tree light mounting assembly which may be easily and efficiently manufactured and marketed.

It is a further object of the present invention to provide a new and improved sliding Christmas tree light mounting assembly which is of a durable and reliable construction.

An even further object of the present invention is to provide a new and improved sliding Christmas tree light mounting assembly which is susceptible of a low cost of manufacture with regard to both materials and labor, and which accordingly is then susceptible of low prices of sale to the consuming public, thereby making such sliding Christmas tree light mounting assembly economically available to the buying public.

Still yet another object of the present invention is to provide a new and improved sliding Christmas tree light mounting assembly which provides in the apparatuses and methods of the prior art some of the advantages thereof, while simultaneously overcoming some of the disadvantages normally associated therewith.

Still another object of the present invention is to conveniently mount a string of lights on a house.

Lastly, it is an object of the present invention to provide a new and improved sliding Christmas tree light mounting assembly including a house having a fascia. A string of lights include an elongated flexible insulated wire with multiple light bulbs spaced along a length thereof and electrically connected to the same for receiving power therefrom. At least one elongated linear slider track is included. A plurality of slider clips are slidably coupled to the slider track and adapted to releasably secure to the string of lights for mounting the same to the fascia.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a front view of the couple of the present invention.

FIG. 6 is a cross-sectional view of the present invention taken along line 6—6 shown in FIG. 5.

FIG. 7 is a perspective illustration of the tool of the present invention during use.

Similar reference characters refer to similar parts throughout the several views of the drawings.

DESCRIPTION OF THE PREFERRED EMBODIMENT

Figure 1:
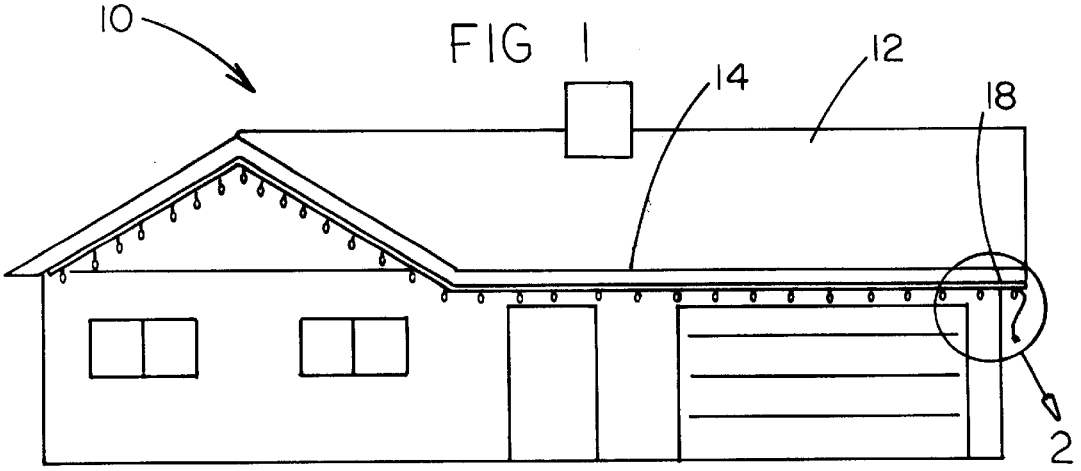
FIG. 1 is a perspective illustration of the preferred embodiment of the sliding Christmas tree light mounting assembly constructed in accordance with the principles of the present invention.
Figure 2:
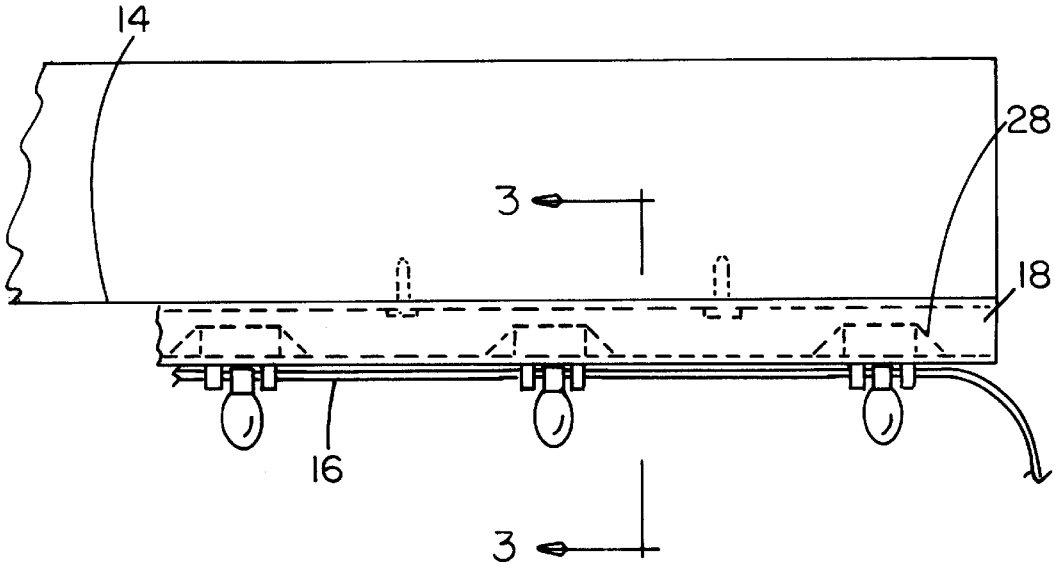
FIG. 2 is a front view of the slider tracks and slider clips of the present invention.

With reference now to the drawings, and in particular to FIG. 1 thereof, a new and improved sliding Christmas tree light mounting assembly embodying the principles and concepts of the present invention and generally designated by the reference numeral 10 will be described.

The present invention, the new and improved sliding Christmas tree light mounting assembly, is comprised of a plurality of components. Such components in their broadest context include slider tracks and slider clips. Such components are individually configured and correlated with respect to each other so as to attain the desired objective.

More specifically, it will be noted that the system 10 of the present invention includes a house 12 having a fascia 14. The fascia includes a horizontal extent and a pair of bevelled extents which form an apex. Also included is a string of lights 16 having an elongated flexible insulated wire with multiple light bulbs spaced along a length thereof. Such bulbs are electrically connected to the wire for receiving power therefrom.

As shown in the Figures, a plurality of elongated linear slider tracks 18 are provided. Each of the slider tracks includes an elongated rectangular top face, bottom face, front face, rear face and a pair of square open ends. The bottom face of each track has a slot 20 formed therein along a length thereof. The slot is centrally located on the track and further has a width that is about ⅓ that of the bottom face. The top face of each track has a plurality of circular apertures 22 formed therein along a length thereof. The apertures function for allowing the screwable mounting of each track to a lower face of an associated one of the extents of the fascia. For reasons that will become apparent later, ends of the track may be equipped with removable plugs.

Next provided is an inverted V-shaped couple 24 having a pair of hollow side extents each with a square cross-section. As shown in FIG. 5, the couple is adapted for releasably receiving an end of a pair of the slider tracks and maintaining the same at a predetermined angle. In the preferred embodiment, the couple has a slot 26 formed along an entire bottom face thereof for affording a resilient clamping affect on the slider tracks and further allowing access to the slots of the slider tracks. During use, the couple is situated at the apex of the bevelled extents of the fascia. It should be noted that the couple may also be simply linear to couple ends of multiple slider tracks along an elongated horizontal extent of the fascia.

Figure 3:
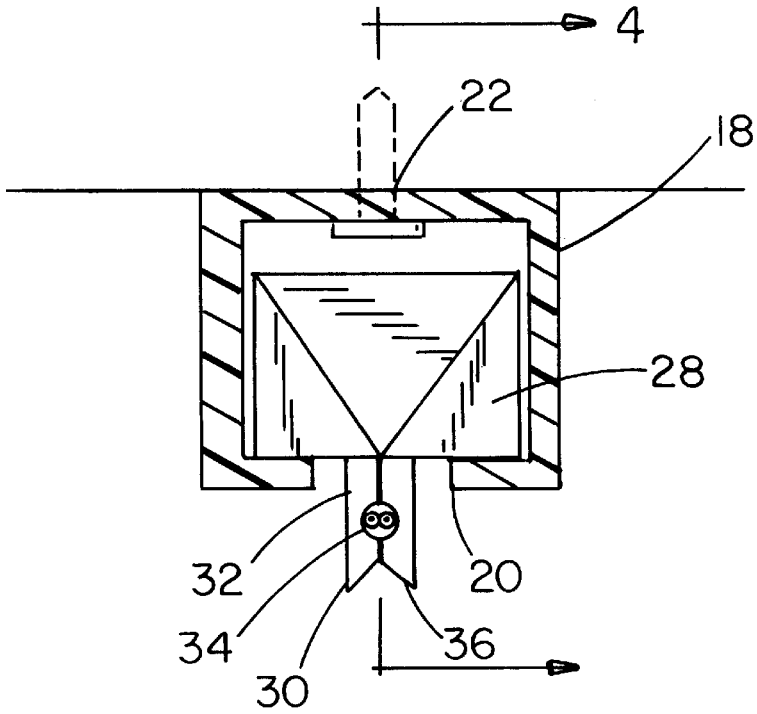
FIG. 3 is a cross-sectional view of the present invention taken along line 3—3 shown in FIG. 2.
Figure 4:
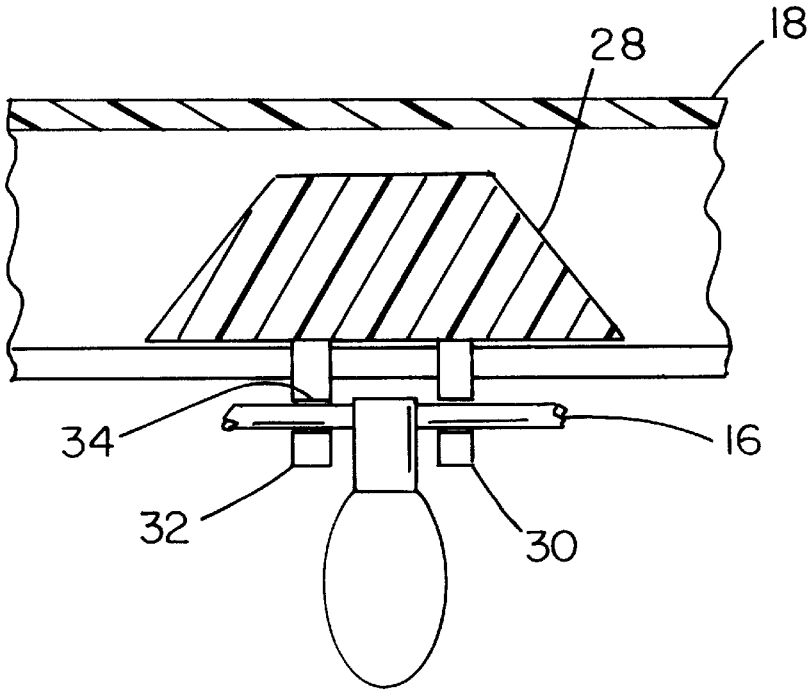
FIG. 4 is a cross-sectional view of the present invention taken along line 4—4 shown in FIG. 3.

FIGS. 3 & 4 best show a plurality of slider clips 28 each having a trapezoidal-shaped cross-section in a vertical plane situated along a central extent thereof. Each slider clip further has a rectangular planar bottom face, a rectangular planar top face, and a pair of pyramid-shaped end extents. The bottom face is preferably equal to that of the slider track. Further, a height of each slider clip is about ¾ that of the slider track.

The bottom face of each slider clip has a pair of spaced vertically oriented clip members 30. Each clip member has a top end integrally and spacedly coupled to the bottom face of the slider clip and extended downwardly therefrom. In use, the slider clips are slidably mounted within a corresponding track with the clip members extending downwardly through the slot. Each clip member has a height approximately equal that of the remaining portion of the slider clip.

As shown in FIG. 3, each clip member includes a pair of abutting resilient posts 32. A pair of semicircular cut outs 34 are formed in the posts of the clip member. Together, the cut outs define a circular bore which remains in coaxial relationship with that of the other clip of the slider clip. A pair of tapering bottom ends 36 of the posts form an apex directly below the circular bore of the clip member. By this structure, the wire of the string of lights may be removably situated between the posts of each clip member and maintained within the circular bore thereof. As shown in FIG. 4, each light bulb of the string of lights is situated between the clip members of an associated slider clip.

Finally, a tool 38 includes an elongated cylindrical post having a generally J-shaped hook mounted to an end thereof. The tool serves for facilitating either the installation or the removal of the string of lights from the slider clips. As an option, the post of the tool may have a variable length. Further, a brush may be provided to clean an interior of the slider tracks prior to use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved sliding Christmas tree light mounting assembly comprising, in combination:

a house having a fascia including a horizontal extent and a pair of bevelled extents which form an apex;

a string of lights including an elongated flexible insulated wire with multiple light bulbs spaced along a length thereof and electrically connected to the same for receiving power therefrom;

a plurality of elongated linear slider tracks each including an elongated rectangular top face, bottom face, front face, rear face and a pair of square open ends, the bottom face of each track having a slot formed therein along a length thereof, the top face of each track having a plurality of circular apertures formed therein along a length thereof for allowing the mounting of each track to a lower face of an associated one of the extents of the fascia;

an inverted V-shaped couple having a pair of hollow side extents each with a square cross-section for releasably receiving an end of a pair of the slider tracks and maintaining the same at a predetermined angle, wherein the couple is situated at the apex of the bevelled extents of the fascia;

a plurality of slider clips each having a trapezoidal-shaped cross-section in a vertical plane situated along a central extent thereof, each slider clip further having a rectangular planar bottom face, a rectangular planar top face, and a pair of pyramid-shaped end extents, the bottom face having a pair of spaced vertically oriented clip members each having a top end integrally spacedly coupled to the bottom face of the slider clip and extending downwardly therefrom wherein the slider clips are slidably mounted within a corresponding track with the clip members extending downwardly through the slot thereof, each clip member including a pair of abutting resilient posts, a pair of semicircular cut outs formed in the posts of the clip member which together define a circular bore which remains in coaxial relationship with that of the other clip of the slider clip, and a pair of tapering bottom ends which form an apex directly below the circular bore of the clip member, whereby the wire of the string of lights may be removably situated between the posts of each clip member and further be maintained within the circular bore thereof with each light bulb of the string of lights being situated between the posts of the clip members of an associated slider clip; and a tool including an elongated cylindrical post having a generally J-shaped hook mounted to an end thereof for facilitating at least one of the installation and the removal of the string of lights from the slider clips.

2. A sliding Christmas tree light mounting assembly comprising:

a house having a fascia;

a string of lights including an elongated flexible insulated wire with multiple light bulbs spaced along a length thereof and electrically connected to the same for receiving power therefrom;

at least one elongated linear slider track; and a plurality of slider clips slidably coupled to the slider track and adapted to releasably secure to the string of lights for mounting the same to the fascia.

3. A sliding Christmas tree light mounting assembly as set forth in claim 2 wherein each slider track has a slot through which a clip member of each slider clip extends.

4. A sliding Christmas tree light mounting assembly as set forth in claim 2 wherein each slider clip has a pair of clip members between which one of the light bulbs of the string of lights is situated.

5. A sliding Christmas tree light mounting assembly as set forth in claim 2 wherein each slider member has at least one clip member comprising of a pair of resilient abutting posts.

6. A sliding Christmas tree light mounting assembly as set forth in claim 5 wherein each post has a semicircular cut out formed therein.

7. A sliding Christmas tree light mounting assembly as set forth in claim 5 wherein a bottom of each post is tapered to form an apex.

8. A sliding Christmas tree light mounting assembly as set forth in claim 2 wherein the house includes a pair of bevelled extents which form an apex, an inverted V-shaped couple having a pair of hollow side extents for releasably receiving an end of a pair of the slider tracks and maintaining the same at a predetermined angle, wherein the couple is situated at the apex of the bevelled extents of the fascia.

9. A sliding Christmas tree light mounting assembly as set forth in claim 2 and further including a tool having an elongated post having a hook mounted to an end thereof for facilitating at least one of the installation and the removal of the string of lights from the slider clips.

* * * * *